US006744208B2

(12) United States Patent
Kado et al.

(10) Patent No.: US 6,744,208 B2
(45) Date of Patent: Jun. 1, 2004

(54) DISCHARGE LIGHT-EMITTING DEVICE AND METHOD MANUFACTURE THEREOF

(75) Inventors: Hiroyuki Kado, Ibaraki (JP); Kanako Miyashita, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/182,174

(22) PCT Filed: Jan. 25, 2001

(86) PCT No.: PCT/JP01/00485

§ 371 (c)(1),
(2), (4) Date: Oct. 9, 2002

(87) PCT Pub. No.: WO01/56053

PCT Pub. Date: Aug. 2, 2001

(65) Prior Publication Data

US 2003/0137247 A1 Jul. 24, 2003

(30) Foreign Application Priority Data

Jan. 26, 2000 (JP) ..... 2000-016773
Feb. 8, 2000 (JP) ..... 2000-030050

(51) Int. Cl.[7] ..... H01J 61/42
(52) U.S. Cl. ..... 313/637; 313/581; 445/15; 445/25

(58) Field of Search ..... 313/582, 581, 313/637; 445/24, 25, 15

(56) References Cited

U.S. PATENT DOCUMENTS

| | | | | |
|---|---|---|---|---|
| 3,886,393 A | | 5/1975 | Hinson | |
| 4,725,255 A | * | 2/1988 | Shinada et al. | 445/25 |
| 5,793,158 A | * | 8/1998 | Wedding, Sr. | 313/493 |

FOREIGN PATENT DOCUMENTS

| | | |
|---|---|---|
| JP | 49-53761 | 5/1974 |
| JP | 56-5014 | 3/1981 |
| JP | 09092161 A | 4/1997 |
| JP | 09245653 A | 9/1997 |
| JP | 11120920 A | 4/1999 |
| JP | PCT/JP01/00485 | 1/2001 |

* cited by examiner

*Primary Examiner*—David Vu

(57) ABSTRACT

A discharge light-emitting device includes a gas-filled discharge spaces (30) to use electric discharge in the gas. The gas contains at least 0.01–1% water vapor by volume. The specified amount of water vapor decreases discharge voltage markedly. Water vapor is introduced between a sealing step and an evacuation step so that the gas-filled discharge spaces can finally contain a desired amount of water vapor.

37 Claims, 9 Drawing Sheets

DISCHARGE LIGHT-EMITTING DEVICE AND METHOD MANUFACTURE THEREOF

TECHNICAL FIELD

The present invention relates to a gas discharge light-emitting device, such as a plasma display device, a noble-gas barrier discharge lamp, and an electrodeless discharge lamp, which is used for image display in computer monitors, televisions, and the like, and a manufacturing method for the gas discharge light-emitting device.

BACKGROUND ART

FIG. 10 is a sectional view showing a construction of a panel part of a conventional AC (alternating current) plasma display device.

In the drawing, reference numeral 201 denotes a front glass substrate. A plurality of pairs of display electrode lines 202 are formed in parallel with each other on the front glass substrate 201. A dielectric glass layer 203 is formed over the display electrode lines 202. A protective layer 204 made of magnesium oxide is formed on the dielectric glass layer 203.

Reference numeral 211 denotes a back glass substrate. Address electrode lines 212 are formed on the back glass substrate 211. A visible light reflective layer 213 is formed over the address electrode lines 212. Barrier ribs 214 are formed in parallel with each other on the visible light reflective layer 213, so as to alternate with the address electrode lines 212. Phosphor layers 215 of the three colors (red phosphor layers 215R, green phosphor layers 215G, and blue phosphor layers 215B) are provided in turn to the gaps between adjacent barrier ribs 214. When excited by vacuum ultraviolet light of short wavelength (147 nm) which is generated as a result of discharge, the phosphor layers 215 emit light.

Example phosphors of the three colors typically used are given below:

Blue phosphor: $BaMgAl_{10}O_{17}$:EU

Green phosphor: $Zn_2SiO_4$:Mn or $BaMgAl_{10}O_{17}$:Mn

Red phosphor: $YBO_3$:Eu or $(Y_xGd_{1-x})BO_3$:Eu

Here, a part that is made up of the front glass substrate 201, the display electrode lines 202, the dielectric glass layer 203, and the protective layer 204 is called a front panel, whereas a part that is made up of the back glass substrate 211, the address electrode lines 212, the visible light reflective layer 213, the barrier ribs 214, and the phosphor layers 215 is called a back panel.

Discharge spaces 220 are formed between the front panel and the back panel. A discharge gas that is a noble gas mixture of a predetermined composition (e.g. a gas mixture of helium (He) and xenon (Xe) or of neon (Ne) and xenon (Xe)) is enclosed in the discharge spaces 220 at a predetermined pressure (about 13.3 kPa (100 Torr) to 80 kPa (600 Torr)).

The illumination principle of this plasma display device is fundamentally the same as that of a fluorescent lamp. Voltages are applied to the electrodes to initiate glow discharge, which causes the discharge gas to generate ultraviolet light This ultraviolet light excites the phosphors to emit light.

A specific example of a manufacturing operation of the plasma display device is given below.

The address electrode lines made of silver are formed on the back glass substrate The visible light reflective layer made of dielectric glass is formed on the back glass substrate on which the address electrode lines have been arranged. The barrier ribs made of glass are formed on the visible light reflective layer at a predetermined pitch.

Phosphor pastes of the three colors that each include a different one of the red, green, and blue phosphors are applied in turn to the channels formed between adjacent barrier ribs. The result is fired at a predetermined temperature (e.g. 500° C.), to form the phosphor layers of the three colors.

Once the phosphor layers have been formed, a low-melting point glass paste is applied to the periphery of the back glass substrate as a sealing material that seals the back glass substrate and the front glass substrate together. The back glass substrate is then subjected to pre-baking at a predetermined temperature (e.g. 350° C.), to remove a resin component and the like from the low-melting point glass paste.

Meanwhile, the display electrode lines, the dielectric glass layer, and the protective layer are formed in this order on the front glass substrate, to form the front panel.

The front panel and the back panel are placed one on top of the other so that the display electrode lines cross over the address electrode lines at right angles and the dielectric glass layer face the barrier ribs. The two panels are heated at a predetermined temperature (e.g. 450° C.) to seal them together (sealing process)

After this, the inside of the panel is evacuated to produce a vacuum while heating at a predetermined temperature (e.g. 350° C.) (evacuation process). The discharge gas is then enclosed at a predetermined pressure (discharge gas filling process).

In the gas discharge light-emitting device manufactured in this way, lower discharge voltages are desirable in order to reduce power consumption. To attain lower discharge voltages, special techniques need to be incorporated in the manufacturing operation.

It is also desirable to improve luminous characteristics. To do so, the phosphor characteristics need to be kept from degrading throughout the whole manufacturing operation. It is generally known that a phosphor suffers thermal degradation during the sealing process. To suppress such thermal degradation, special techniques need be incorporated in the manufacturing operation.

DISCLOSURE OF INVENTION

In view of the above problems, the first object of the present invention is to provide a gas discharge light-emitting device such as a plasma display device that achieves low discharge voltages, and a manufacturing method for the gas discharge light-emitting device.

The second object of the present invention is to provide a gas discharge light-emitting device in which phosphors are protected from thermal degradation during the sealing process of the manufacturing operation and which achieves low discharge voltages, and a manufacturing method for the gas discharge light-emitting device.

The first object can be fulfilled by a gas discharge light-emitting device in which a discharge space filled with a gas medium is formed and which uses a discharge of the gas medium in the discharge space, characterized in that the gas medium includes 0.01% to 1% by volume of water vapor.

With this construction, the water vapor in the gas medium delivers a function of amplifying electrons at the time of discharge. This makes it possible to reduce a voltage which is applied to display electrodes to cause discharge (discharge voltage). Which is to say, when colliding with electrons, the water vapor discharges electrons more easily than a discharge gas such as a noble gas. This electron discharge reaction tends to proceed in a cascade-like manner. As a result, electrons are amplified remarkably.

It was found through experimentation that an optimum value for the water vapor content is in a range of 0.01 to 1% by volume to maximize this water vapor function. If the water vapor content is below 0.01% by volume, the electron amplification function of the water vapor will not be so remarkable. It may appear that the effect of reducing the discharge voltage is more remarkable if the water vapor content is greater. However, if the water vapor content exceeds 1% by volume, the discharge voltage begins to rise. Also, if the water vapor content exceeds 1% by volume when the device is used at a low ambient temperature (below freezing), the water vapor condenses into droplets on the walls that enclose the inner space. This produces undesirable effects.

Here, the gas medium may include at least one noble gas selected from the group consisting of helium, neon, xenon, and argon.

Here, electrodes and phosphors may be provided at least in a periphery of the discharge space, wherein the phosphors (a) are excited by one of ultraviolet light and vacuum ultraviolet light which is generated as a result of the discharge in the discharge space, and (b) emit visible light.

Here, surfaces of the electrodes may be covered with a dielectric.

With this construction, it is possible to prevent electrode degradation which is caused by the water vapor being adsorbed on exposed electrodes. If voltages are applied to electrodes on which water vapor has been adsorbed, the components of the electrodes react with the water and as a result the electrodes degrade. This causes problems such as an increase in resistance.

Here, phosphors may be provided at least in a periphery of the discharge space, wherein one of an electric field and a magnetic field is applied from outside of the discharge space to cause an electrodeless discharge of the gas medium, and the phosphors are excited by one of ultraviolet light and vacuum ultraviolet light which is generated as a result of the electrodeless discharge, and emit visible light.

Thus, the present invention is applicable to various gas discharge light-emitting devices. When the invention is applied to an electrodeless lamp, for example, the water vapor existing in the gas medium delivers the aforementioned function to reduce the discharge voltage.

Here, the gas discharge light-emitting device may be sealed in a state where the phosphors are in contact with a dry gas.

With this construction, the second object can be fulfilled, as the thermal degradation of the phosphors in the sealing process can be avoided.

The first object can also be fulfilled by a manufacturing method for a gas discharge light-emitting device, including: a sealing step for sealing a first substrate and a second substrate which are placed one on top of the other with an inner space in between so that phosphors provided on the second substrate face the inner space; an evacuation step for evacuating the inner space to produce a vacuum, after the sealing step; and a discharge gas filling step for introducing a discharge gas that has an adjusted water vapor content, into the inner space after the evacuation step.

With this construction, the water vapor in the discharge gas exhibits the above function of amplifying electrons at the time of discharge, with it being possible to reduce a voltage applied to display electrodes to cause discharge (discharge voltage). Which is to say, when colliding with electrons, the water vapor discharges electrons easily. This electron discharge reaction tends to proceed in a cascade-like manner. As a result, electrons are amplified remarkably.

Here, the water vapor content of the discharge gas to be introduced into the inner space may be adjusted so that the discharge gas having been enclosed in the inner space has a water vapor content in a range of 0.01% to 1% by volume.

Here, the sealing in the sealing step may be performed with the phosphors being in contact with a dry gas.

With this construction, the second object can be fulfilled.

The first object can also be fulfilled by a manufacturing method for a gas discharge light-emitting device, including: a sealing step for sealing a first substrate and a second substrate which are placed one on top of the other with an inner space in between so that phosphors provided on the second substrate face the inner space; a water vapor introducing step for introducing a predetermined amount of water vapor into the inner space, after the sealing step; and an evacuation step for evacuating the inner space to produce a vacuum, after the water vapor introducing step.

With this method, a desired amount of water vapor remains in the inner space of the completed gas discharge light-emitting device, which enables the above electron amplification function of the water vapor to be delivered. Hence a voltage applied to display electrodes to cause discharge (discharge voltage) is reduced. Which is to say, when colliding with electrons, the water vapor discharges electrons easily. This electron discharge reaction tends to proceed in a cascade-like manner. As a result, electrons are amplified remarkably.

It should be noted that "the desired amount of water vapor" is such an amount that makes the electron amplification action remarkable.

Here, the predetermined amount may be adjusted so that a water vapor partial pressure in the inner space once the water vapor has been introduced is no lower than 1.3 kPa (10 Torr) at a normal temperature.

By adjusting the water vapor partial pressure at no lower than 1.3 kPa (10 Torr), the water vapor remains in the device efficiently. This intensifies the electron amplification action of the water vapor.

Here, a gas medium that includes the water vapor may be introduced into the inner space in the water vapor introducing step.

Here, the introduction of the water vapor in the water vapor introducing step may be performed while construction elements of the gas discharge light-emitting device are being heated in a range of 100° C. to 350° C.

With this construction, the water vapor remains in the inner space of the completed gas discharge light-emitting device efficiently, which contributes to improvements in discharge voltage reduction effects. Moreover, in this temperature range, the thermal degradation of the phosphors under the presence of water vapor hardly occurs.

Here, the sealing in the sealing step may be performed with the phosphors being in contact with a dry gas.

With this construction, the second object can be fulfilled.

The first object can also be fulfilled by a manufacturing method for a gas discharge light-emitting device, including: a sealing step for sealing a first substrate and a second substrate which are placed one on top of the other with an inner space in between so that phosphors provided on the second substrate face the inner space; and an evacuation step for evacuating the inner space to produce a vacuum, after the sealing step, wherein the sealing step includes a water vapor introducing step for introducing a predetermined amount of water vapor into the inner space, when a temperature is dropping after construction elements of the gas discharge light-emitting device have been heated to a peak temperature.

With this method, a desired amount of water vapor remains in the inner space of the completed gas discharge light-emitting device, which enables the above electron amplification function of the water vapor to be delivered Hence a voltage applied to display electrodes to cause discharge (discharge voltage) is reduced. Which is to say, when colliding with electrons, the water vapor discharges electrons easily. This electron discharge reaction tends to proceed in a cascade-like manner. As a result, electrons are amplified remarkably.

Furthermore, since the water vapor is introduced into the inner space while the temperature is dropping from the peak, the thermal degradation of the phosphors under the presence of the water vapor will hardly occur. Note here that it is desirable to introduce the water vapor when the temperature is below the point at which the water vapor will react with the phosphors.

Here, the introduction of the water vapor in the water vapor introducing step may be performed when the temperature is in a range of 350° C. to 100° C.

With this method, the water vapor remains in the inner space of the completed gas discharge light-emitting device efficiently. Also, it becomes easier to improve discharge voltage reduction effects. Furthermore, the thermal degradation of the phosphors, including the blue phosphor which is most susceptible to thermal degradation, under the presence of the water vapor will hardly occur in this temperature range.

Here, the predetermined amount may be adjusted so that a water vapor partial pressure in the inner space once the water vapor has been introduced is no lower than 1.3 kPa (10 Torr) at a normal temperature.

By adjusting the water vapor partial pressure at no lower than 1.3 kPa (10 Torr), the water vapor remains in the device efficiently, with it being possible to enhance the electron amplification action of the water vapor.

Here, a gas medium that includes the water vapor may be introduced into the inner space in the water vapor introducing step.

Here, the sealing in the sealing step may be performed with the phosphors being in contact with a dry gas, at least until the construction elements are heated to the peak temperature.

With this method, the second object can be fulfilled.

Here, the dry gas preferably includes oxygen.

TABLE 1 shows various characteristics of panels in the actual example 1 of the invention and its comparative example.

TABLE 2 shows various characteristics of panels in the actual example 2 of the invention and its comparative example.

BEST MODE FOR CARRYING OUT THE INVENTION

The following describes a plasma display device and a manufacturing method for the plasma display device according to the present invention, with reference to the drawings. (Overall Construction and Manufacturing Method of the Plasma Display Device)

Figure 1:
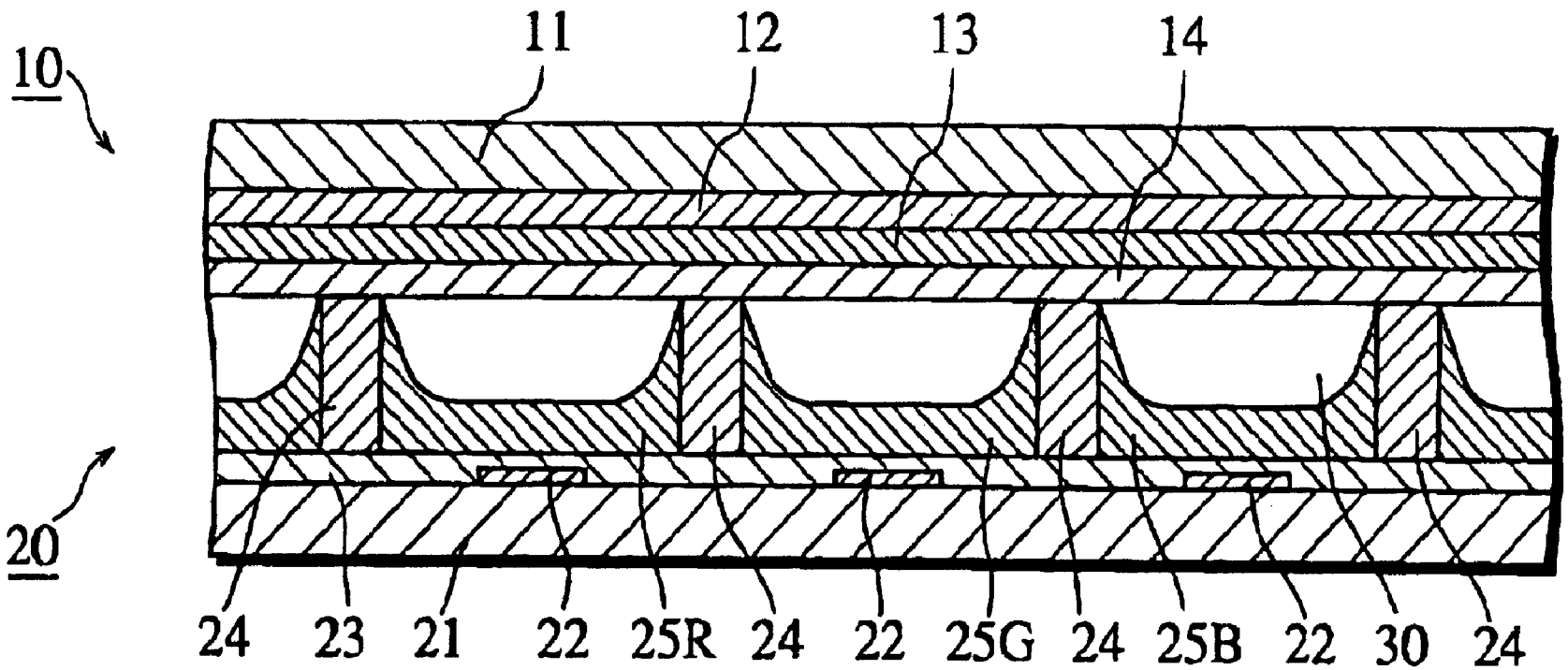
FIG. 1 is a sectional view showing a construction of a panel part of a surface discharge AC plasma display device to which the embodiments of the present invention relate.
Figure 2:
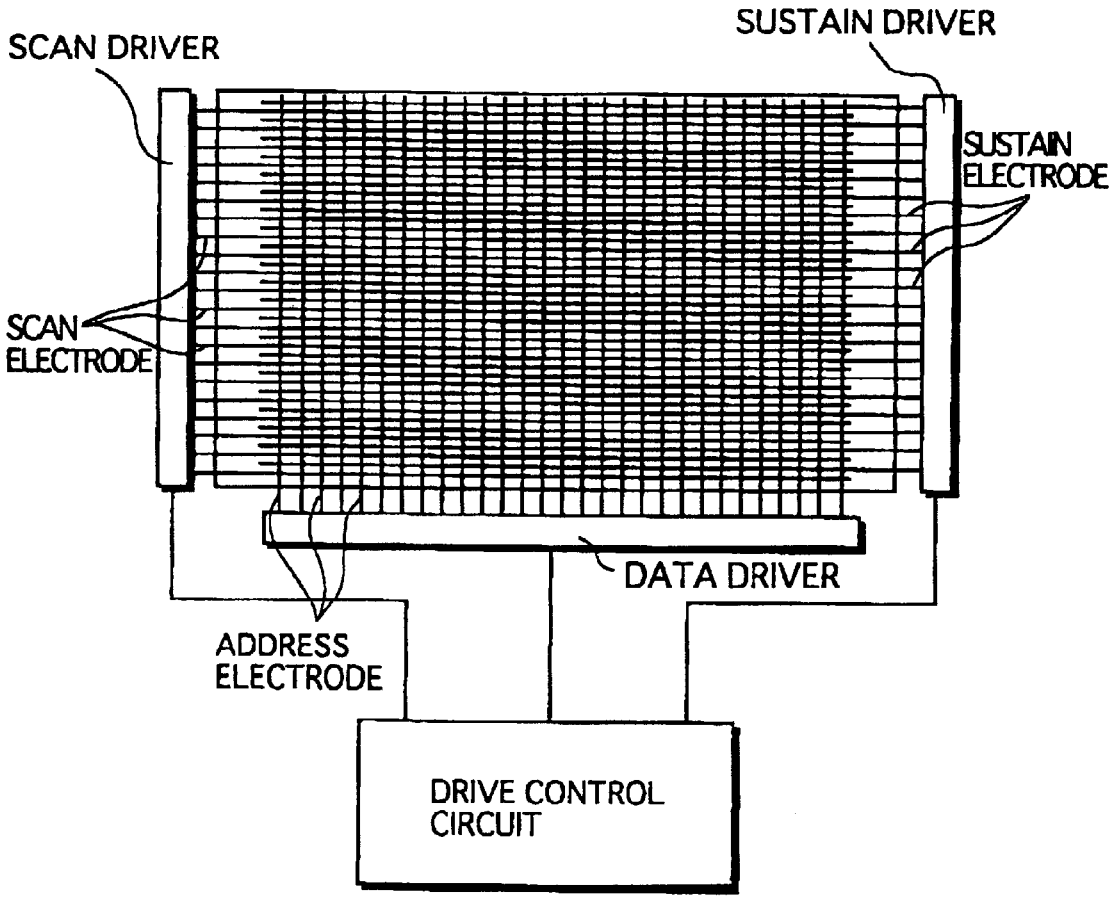
FIG. 2 is a block diagram showing a construction of the device which is provided with the panel and a circuit block.

FIG. 1 is a sectional view showing a construction of a panel part (hereafter referred to as a "PDP" (plasma display panel)) of a surface discharge AC plasma display device to which the embodiments of this invention relate. FIG. 2 is a block diagram showing the device which is equipped with the PDP and a circuit block.

The plasma display device operates as follows. A pulse voltage is applied to each electrode to cause discharge in discharge spaces. As a result of this discharge, visible light of each color is generated in a back panel, and emitted from a main surface of a front panel.

This being so, the PDP has a front panel 10 and a back panel 20. In the front panel 10, a plurality of display electrode lines (i.e. a plurality of pairs of scan electrode lines and sustain electrode lines) 12, a dielectric layer 13, and a protective layer 14 are provided on a front glass substrate 11. In the back panel 20, a plurality of address electrode lines 22 and a dielectric layer (visible light reflective layer) 23 are provided on a back glass substrate 21. The front panel 10 and the back panel 20 are positioned in parallel with each other with a predetermined gap in between, so that the display electrode lines 12 and the address electrode lines 22 cross each other.

The middle part of the PDP is an area for displaying images. Here, the gap between the front panel 10 and the back panel 20 is partitioned by a plurality of stripe barrier ribs 24 to form a plurality of discharge spaces 30. A discharge gas is enclosed in the discharge spaces 30. Also, a plurality of phosphor layers 25 are provided in the discharge spaces 30 on the side of the back panel 20. The phosphor layers 25 are arranged in the order of red (25R), green (25G), and blue (25B) alternately.

The display electrode lines 12 and the address electrode lines 22 are formed in stripes. The display electrode lines 12 are arranged so as to cross over the barrier ribs 24 at right angles, while the address electrode lines 22 are arranged so as to be in parallel with the barrier ribs 24.

The areas where the display electrode lines 12 and the address electrode lines 22 cross each other are cells which emit light of red, green, and blue.

The dielectric layer 13 is made of a dielectric material which is disposed over the entire surface of the front glass substrate 11 on which the display electrode lines 12 have been formed. While low-melting point lead glass is often used for this dielectric layer 13, low-melting point bismuth glass or a laminate of lead glass with a low-melting point and bismuth glass with a low-melting point may be used.

The protective layer 14 is a thin layer of magnesium oxide (MgO), and covers the entire surface of the dielectric layer 13. The dielectric layer 23 contains particles of $TiO_2$, so as to function as a reflective layer for visible light.

The barrier ribs 24 are formed of a glass material, and are shaped so as to protrude upwards on the surface of the dielectric layer 23 of the back panel 20.

The front panel 10 and the back panel 20 are sealed with a sealing material along the periphery of the PDP.

The upper surfaces of the barrier ribs 24 are almost entirely in contact with the front panel 10, or are almost entirely bonded to the front panel 10 with a bonding agent.

Drivers and a drive control circuit are connected to the PDP of this construction, as shown in FIG. 2. Hence image display is performed according to a field timesharing display method, though its detailed explanation has been omitted here.

An example method of manufacturing such a PDP is given below.

(Manufacture of the Front Panel)

The display electrode lines 12 are formed on the front glass substrate 11. The dielectric layer 13 is formed on the front glass substrate 11 so as to cover the display electrode lines 12. The protective layer 14 made of magnesium oxide (MgO) is formed on the dielectric layer 13 using a vacuum vapor deposition method, an electron beam evaporation method, or a CVD method. This completes the front panel.

The display electrode lines 12 can be formed by screen-printing a silver electrode paste and firing the printed paste. The display electrode lines 12 may also be formed by forming transparent electrodes of ITO (indium tin oxide) or $SnO_2$ and then forming silver electrodes on the transparent electrodes as mentioned above, or by forming Cr—Cu—Cr electrodes using a photolithography method.

The dielectric layer 13 can be formed by screen-printing a paste including a lead glass material (an example composition of which is 70% by weight of lead oxide (PbO), 15% by weight of boron oxide ($B_2O_3$), and 15% by weight of silicon oxide ($SiO_2$)), and firing the printed paste (Manufacture of the Back Panel)

The address electrode lines 22 are formed on the back glass substrate 21 using screen printing, in the same way as the display electrode lines 12.

Next, a glass material mixed with $TiO_2$ particles is screen-printed and fired to form the dielectric layer 23.

Following this, the barrier ribs 24 are formed on the dielectric layer 23. The barrier ribs 24 can be formed by screen-printing a barrier rib glass paste repeatedly and then firing it. The barrier ribs 24 can also be formed by applying a barrier rib glass paste to the entire surface of the dielectric layer 23 and removing the parts at which the barrier ribs should not be formed using sandblasting.

The phosphor layers 25 are formed in the channels between adjacent barrier ribs 24 The phosphor layers 25 are typically formed by screen-printing a phosphor paste including phosphor particles of each color and firing the result. The phosphor layers 25 can also be formed by continuously expelling a phosphor ink from a nozzle that scans the channels, and firing the result to remove a solvent and a binder which are included in the phosphor ink. This phosphor ink can be obtained by dispersing phosphor particles in a mixture of a binder, a solvent, a dispersant, and the like. The viscosity of the phosphor ink has been adjusted appropriately.

Specific examples of phosphor particles are given below:

Blue phosphor: $BaMgAl_{10}O_{17}$:EU

Green phosphor: $BaMgAl_{10}O_{17}$:Mn or $Zn_2SiO_4$:Mn

Red phosphor: $(Y_xGd_{1-x})BO_3$:Eu or $YBO_3$:Eu

Here, the barrier ribs have a height of 0.06 to 0.15 mm and a pitch of 0.13 to 0.36 mm, in keeping with the requirements for a 40-inch VGA or high-definition television.

(Sealing Process, Evacuation Process, and Discharge Gas Filling Process)

Following this, the front panel 10 and the back panel 20 are sealed together In this sealing process, the front panel 10 and the back panel 20 are sandwiched together with a sealing material being interposed along the outer edges, thereby forming an envelope. The two panels 10 and 20 are then sealed to each other using the sealing material. Here, an adhesive may be applied to the upper surfaces of the barrier ribs 24 in the back panel 20 as necessary.

A material that softens when energy such as heat is applied from outside is used as the sealing material. A typical sealing material is low-melting point glass. After the sealing material is softened by heating to its softening temperature (sealing temperature), the sealing material is cured by cooling, as a result of which the two panels 10 and 20 are sealed together.

After the sealing process, the inner spaces are evacuated to produce a high vacuum (e.g. $1.3\times10^{-11}$ MPa), to expel impurity gas and the like which are adsorbed to the inside of the envelope (evacuation process).

After the evacuation process, a discharge gas (e.g. a noble gas of He—Xe, Ne—Xe, or Ar—Xe) is enclosed in the envelope at a predetermined pressure (discharge gas filling process). This completes the PDP.

Here, the Xe content of the discharge gas is set at about 5% by volume, and the filling pressure is set within a conventional range of 13.3 kPa (100 Torr) to 80 kPa (600 Torr).

Each embodiment of the present invention is described next.

(First Embodiment)

In the first embodiment, the sealing in the sealing process is performed while supplying dry gas such as air or noble gas whose water vapor partial pressure has been adjusted at no higher than 0.13 kPa (1 Torr) into the inner spaces of the PDP.

Usually, gas such as water vapor is adsorbed to the front panel and back panel. This being so, when these panels are heated, the adsorbed gas is released.

Here, if the sealing is performed without supplying dry gas to the inner spaces, the following problem may occur.

In the sealing process, after the front panel and the back panel are placed one on top of the other at ambient temperature, the two panels are heated to seal them together. During this time, gas which has been adsorbed to the front and back panels is released. Which is to say, gas in the air is adsorbed to the two panels while the two panels are left in the atmosphere at ambient temperature before the sealing process begins. This being so, once the sealing process begins and the two panels are heated, the adsorbed gas is released from the surfaces of the panels, and trapped in the small inner spaces. It was found by measurement that during this time (during the heating) the water vapor partial pressure in the inner spaces is 20 Torr or more.

The released gas, and especially the released water vapor, tend to cause thermal degradation of the phosphor layers which are exposed to the inner spaces.

Figure 3:
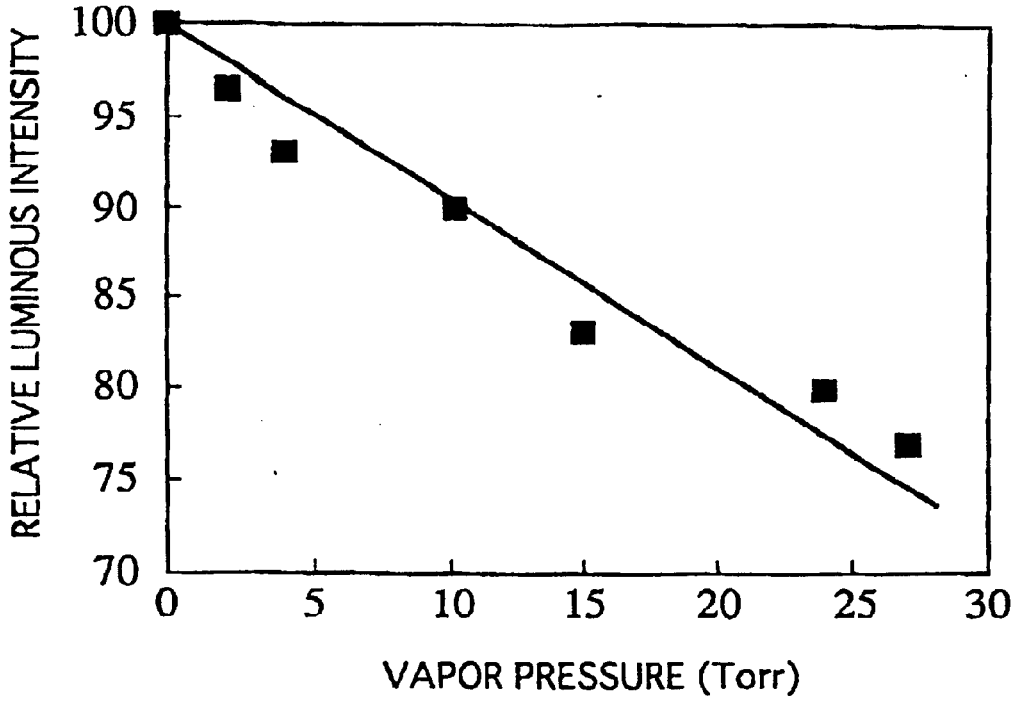
FIG. 3 shows the result of measuring the water vapor partial-pressure dependence of the relative luminous intensity while changing the water vapor partial pressure of the air, when the blue phosphor $BaMgAl_{10}O_{17}$:Eu is fired at 450° C. for 20 minutes.
Figure 4:
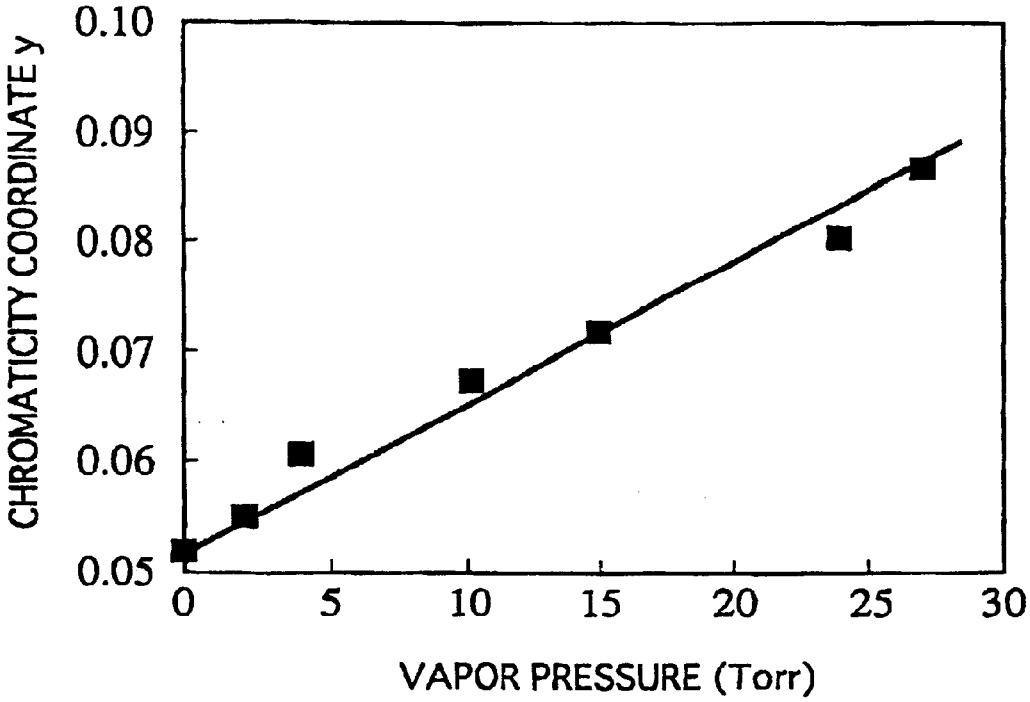
FIG. 4 shows the result of measuring the water vapor partial-pressure dependence of the chromaticity coordinate y while changing the water vapor partial pressure of the air, when the blue phosphor $BaMgAl_{10}O_{17}$:Eu is fired at 450° C. for 20 minutes.

This is clear from the following data obtained by measurement. FIG. 3 shows the result of measuring the water vapor partial-pressure dependence of the relative luminous intensity while changing the water vapor partial pressure of the air, when the blue phosphor $BaMgAl_{10}O_{17}$:Eu is fired at 450° C. for 20 minutes. FIG. 4 shows the result of measuring the water vapor partial-pressure dependence of the chromaticity coordinate y while changing the water vapor partial pressure of the air, when the blue phosphor $BaMgAl_{10}O_{17}$:Eu is fired at 450° C. for 20 minutes. The relative luminous intensity was measured with the luminous intensity of the blue phosphor before firing being set at 100.

Also, the chromaticity coordinate y of the blue phosphor before firing was 0.052. The water vapor partial pressure was measured at ambient temperature (25° C.).

When the water vapor partial pressure was around 0 Pa (0 Torr), the thermal degradation of the luminous intensity and the chromaticity change due to heating were hardly observed. However, the relative luminous intensity decreased and the chromaticity coordinate y increased as the water vapor partial pressure rose. When the chromaticity coordinate y of the blue phosphor increases in this way, the PDP suffers the problems such as the narrowing of the color reproduction area and the decrease of the color temperature.

It is widely believed that when heated the phosphor suffers the decrease of the luminous intensity and the increase of the chromaticity coordinate y because $Eu^{2+}$ ions which are an activation agent become $Eu^{3+}$ ions as a result of the heating. However, the above measurement results on the water vapor partial-pressure dependence indicate that the degradation is caused not by the oxidative reaction between the oxygen gas and the activation agent existing in the inner spaces but by the water vapor which is present in the inner spaces. In other words, by reducing the water vapor partial pressure in the atmosphere, the thermal degradation of the phosphor caused by heating can be prevented.

In view of this, in the present embodiment the sealing is performed while supplying dry gas such as air or noble gas whose water vapor partial pressure is no greater than 0.13 kPa (1 Torr), into the inner spaces (the discharge spaces) where the phosphors are present. In doing so, the thermal degradation of the phosphors in the sealing process can be prevented.

In the sealing process for sandwiching and sealing the front and back panels together, gas is trapped in the small spaces which are separated by the barrier ribs and the like. When the two panels are heated, gas that contains water vapor is released from the protective layer (the MgO layer) of the front panel, the phosphor layers of the back panel, or the sealing material. The phosphors are greatly affected by this gas. Therefore, it is important to create a dry atmosphere in the inner spaces to which the phosphors are exposed, in the sealing process.

When oxide phosphors such as $BaMgAl_{10}O_{17}$:Eu, $Zn_2SiO_4$:Mn, and (Y, Gd)$BO_3$:Eu which are typically used for PDPs are heated in an oxygen-free atmosphere, some oxygen defects may appear and cause a drop in luminous efficiency. Accordingly, it is preferable for the dry gas used in the sealing process to contain at least oxygen. The same applies to the other embodiments.

Also, this embodiment uses gas which is richer in water vapor than usual, as the discharge gas to be enclosed in the PDP in the discharge gas filling process.

To prevent the thermal degradation of the phosphors, it is desirable to heat the PDP while supplying dry gas that does not contain a lot of water vapor in the sealing process, as explained above. However, the discharge voltage tends to increase as the atmospheric gas in the sealing process is drier, i.e., as the effect of preventing the thermal degradation of the phosphors is greater.

Figure 5:
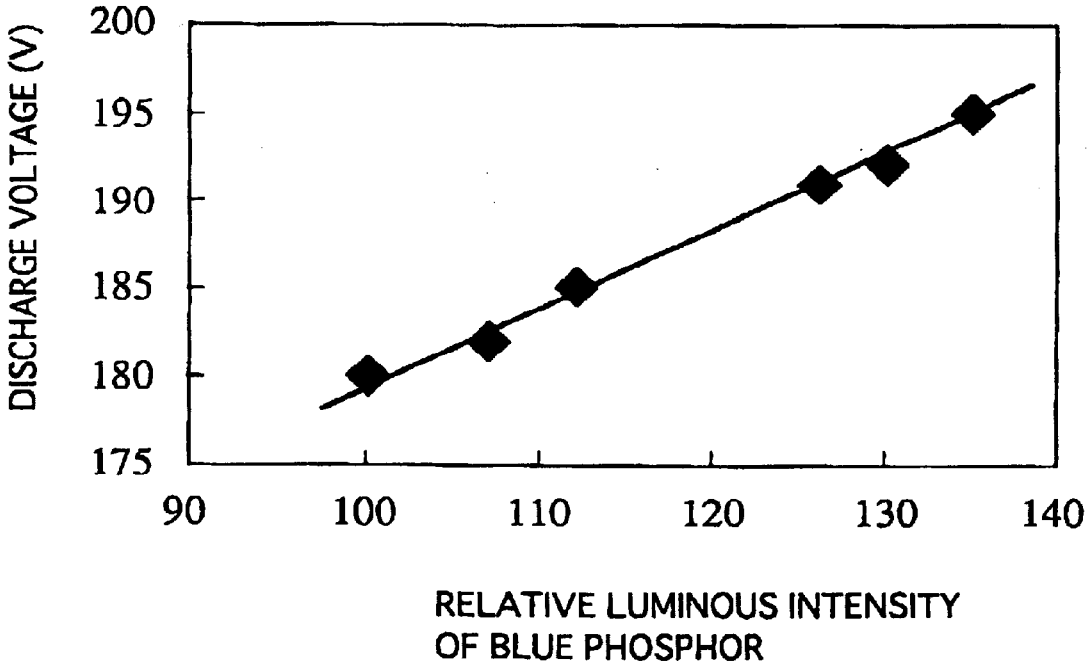
FIG. 5 shows the luminous intensity of the blue phosphor and the discharge voltage, while changing the water vapor partial pressure of the dry air which is sent into the panel in the sealing process.

This is clear from the following data obtained by measurement. FIG. 5 shows the luminous intensity of the blue phosphor and the discharge voltage while changing the water vapor partial pressure of the dry air which is sent into the inner spaces of the PDP during the sealing process. The discharge voltage referred to here is a minimum voltage required to illuminate the entire PDP in white color display.

As can be understood from the drawing, the discharge voltage decreases as the luminous intensity of the phosphor decreases, that is, as more water remains inside the PDP in the sealing process.

In view of this, this embodiment uses a discharge gas that is a gas mixture of He—Xe, Ne—Xe, Ar—Xe, or the like which is richer in water vapor than ordinary discharge gas. In more detail, the discharge gas used in this embodiment contains 0.01 to 1% by volume of water vapor in the state of being enclosed.

By defining the water vapor content in such a way, the increase of the discharge voltage can be avoided.

A probable reason that the discharge voltage is lowered by the inclusion of water vapor in the discharge gas can be attributed to an electron amplification action of the water vapor. Which is to say, when colliding with electrons, the water vapor emits electrons more easily than ordinary gas. This electron emission reaction tends to proceed like a cascade As a result, electrons are amplified remarkably, which allows the discharge voltage to drop.

Though water vapor is certainly contained in discharge gas in conventional PDPs, the water vapor content defined in this embodiment is greater than the conventional amount. This enhances the electron amplification action of the water vapor, with it being possible to decrease the discharge voltage when compared with conventional PDPs (under the same illumination condition).

Also, there is conventionally no such idea that the discharge voltage can be reduced by controlling the amount of water vapor. On the other hand, this embodiment controls the water vapor partial pressure of the discharge gas to reduce the discharge voltage. This control can be done relatively easily. Since the heating is performed while supplying dry gas with a limited water vapor content during the sealing process, the amount of residual water vapor in the PDP after the sealing process is very low. In other words, there is a high degree of dryness in the PDP. Water vapor is introduced in such a dry state, so that the water vapor content of the discharge gas in the completed PDP can be adjusted without difficulty. In other words, since the dryness of the inside of the PDP enclosed.

(Actual Example 1)

A plurality of panels were manufactured under different manufacturing conditions based on the first embodiment and the like. The characteristics of each panel are shown in TABLE 1.

TABLE 1

| PANEL NO. | VAPOR CONTENT OF DISCHARGE GAS IN PANEL (vol %) | RELATIVE LUMINOUS INTENSITY OF BLUE PHOSPHOR | CHROMATICITY COORDINATE y OF BLUE PHOSPHOR | DISCHARGE VOLTAGE (V) |
|---|---|---|---|---|
| 1 | 0.01 | 135 | 0.060 | 176 |
| 2 | 0.05 | 133 | 0.061 | 168 |
| 3 | 0.1 | 131 | 0.063 | 165 |
| 4 | 0.5 | 129 | 0.055 | 162 |
| 5 | 0.05 | 100 | 0.090 | 166 |

TABLE 1-continued

| PANEL NO. | VAPOR CONTENT OF DISCHARGE GAS IN PANEL (vol %) | RELATIVE LUMINOUS INTENSITY OF BLUE PHOSPHOR | CHROMATICITY COORDINATE y OF BLUE PHOSPHOR | DISCHARGE VOLTAGE (V) |
|---|---|---|---|---|
| 6 | <0.001 | 135 | 0.060 | 195 |
| 7 | 0.005 | 100 | 0.090 | 180 |

Panels 1 to 5 correspond to the actual example and were manufactured based or the above embodiment In these panels, vapor-containing gas was introduced as discharge gas, with the water vapor content of the gas being varied for each panel. In panels 1 to 4, the sealing was performed with the panel inside being set in a dry atmosphere. In panel 5, the sealing was performed with the panel inside being set not in a dry atmosphere.

Panels 6 and 7 correspond to the comparative example. In panel 6, the sealing was performed with the panel inside being set in a dry atmosphere, and a conventional discharge gas with little water vapor (a gas mixture of Ne and Xe that contains little water vapor) was introduced. In panel 7, the sealing was performed with the panel inside being set not in a dry atmosphere, and a conventional discharge gas with little water vapor was introduced.

The water vapor content of discharge gas in each panel was measured by disassembling the panel after the illumination evaluation, extracting the discharge gas from the panel, and performing a measurement using a quadruple mass spectrometer. In panels 6 and 7, water or the like adsorbed to the panel inside partially desorbed and was contained in the enclosed discharge gas (though the content was below 0.01% by volume).

The size of each panel was 42 inches.

Each panel has the same construction and differs only in discharge gas. The thickness of the phosphor layers is 30:m. A gas mixture of Ne (95% by volume) and Xe (5% by volume) or a gas mixture of Ne (95% by volume) and Xe (5% by volume) with an arbitrary water vapor content was used as discharge gas. The filling pressure was 66.5 kPa (500 Torr) for all panels.

In the illumination evaluation, the luminous intensity (a value obtained by dividing the luminance by the chromaticity coordinate y) and chromaticity coordinate y of the blue phosphor, and the discharge voltage (a minimum voltage required to illuminate the entire panel in white color display) were measured. The blue luminous intensity is expressed relative to the luminous intensity of panel 7 which is set at 100.

Comparing the discharge voltage characteristics of each panel indicates the following. With the introduction of water vapor, the discharge voltage can be reduced when compared with the conventional panels (panels 6 and 7). The discharge voltage was lower when the water vapor content was higher. However, if the water vapor content is too high, condensation occurs inside the panel, which makes discharge unstable, causing abnormal discharge or the like. Accordingly, the water vapor content of the discharge gas is preferably 0.01 to 1% by volume.

In the panels where the sealing was performed in a dry atmosphere (panels 1–4 and 6), the thermal degradation of the phosphor was prevented and as a result high characteristics were observed in luminous intensity and chromaticity coordinatey. In the panels where the sealing was not performed in a dry atmosphere (panels 5 and 7), on the other hand, the thermal degradation of the phosphor was not prevented and as a result low characteristics were observed in luminous intensity and chromaticity coordinate y.

This demonstrates that the phosphor characteristics and the discharge voltage can both be improved by performing the sealing in a dry atmosphere and introducing discharge gas that contains a predetermined amount of water vapor.

(Second Embodiment)

In the second embodiment, the sealing in the sealing process is performed while supplying dry gas such as air or noble gas whose water vapor partial pressure has been adjusted within 0.13 kPa (1 Torr), as in the first embodiment. In so doing, the thermal degradation of the phosphors in the sealing process can be avoided.

Also, instead of introducing water vapor in the discharge gas filling process, the manufacturing operation of this embodiment includes a process of introducing a gas medium such as air or noble gas that contains a predetermined amount of water vapor into the PDP between the sealing process and the evacuation process, in order to reduce the discharge voltage.

Figure 6:
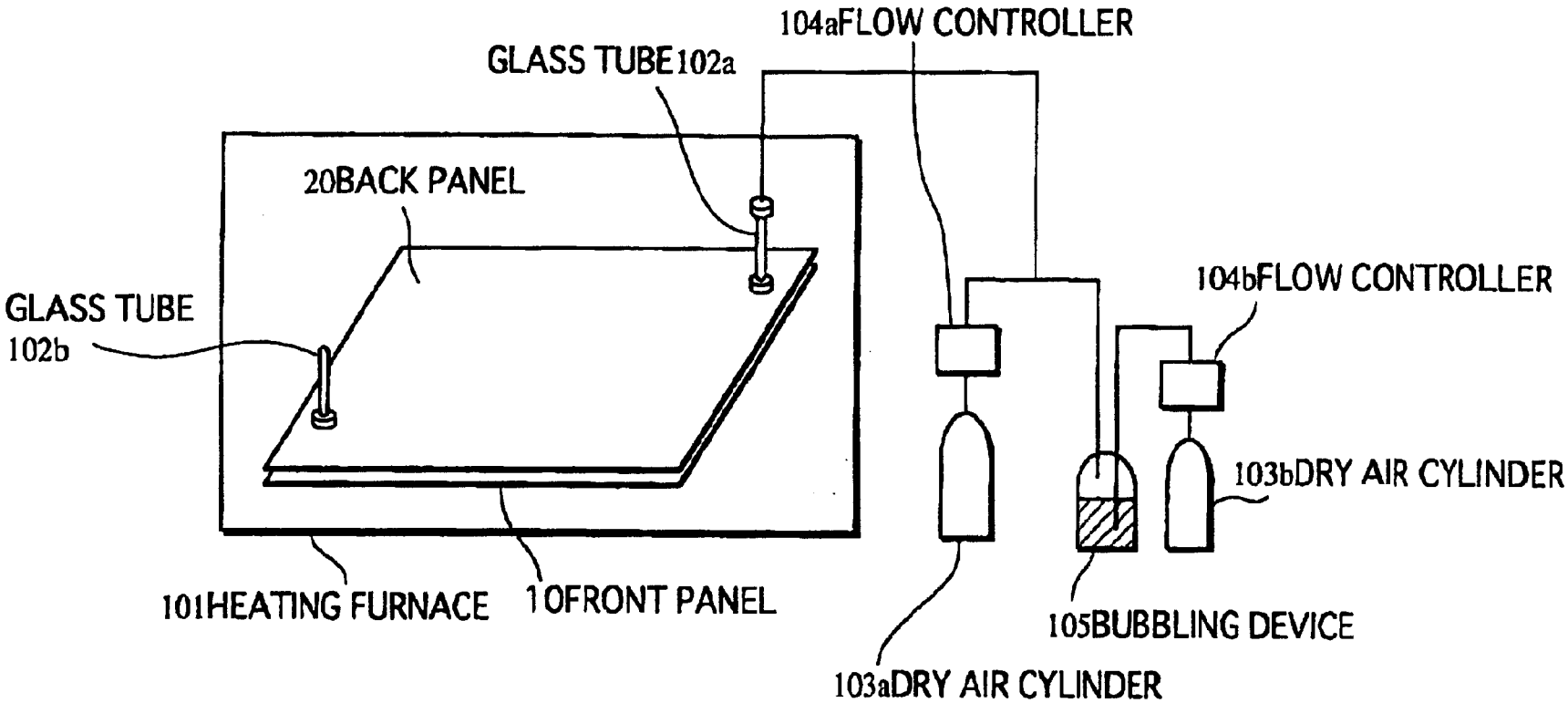
FIG. 6 illustrates a water vapor introduction method in the second embodiment.

This process can be carried out using the following device. FIG. 6 is a plan view showing a construction of a manufacturing device used in this process.

First, the sealed PDP is placed in a heating furnace 101. Here, glass tubes 102*a* and 102*b* that also serve as exhaust tubes are provided to the back panel 20. Air whose water vapor partial pressure has been adjusted by dry air cylinders 103*a* and 103*b*, flow controllers 104*a* and 104*b*, and a water bubbling device 105 is introduced from the glass tube 102*a* into the PDP, and discharged from the glass tube 102*b*.

The PDP was heated to a certain temperature in the heating furnace 101 while supplying the vapor-containing air into the PDP. This causes water vapor to remain in the PDP. The water vapor remaining in the PDP exhibits the aforementioned electron amplification action, as a result of which the discharge voltage drops. Here, it is preferable to perform the water vapor introduction so that the amount of water vapor which remains in the PDP is in a range of 0.01 to 1% by volume, as explained in the first embodiment. To do so, the amount of water vapor to be introduced into the PDP need be set such that water vapor which falls within the above defined range will remain in the PDP after the evacuation process. It was found that the discharge voltage dropped remarkably when the water vapor partial pressure (at ambient temperature) of the air introduced into the PDP was no less than 1.3 kPa (10 Torr) inside the PDP.

Figure 7:
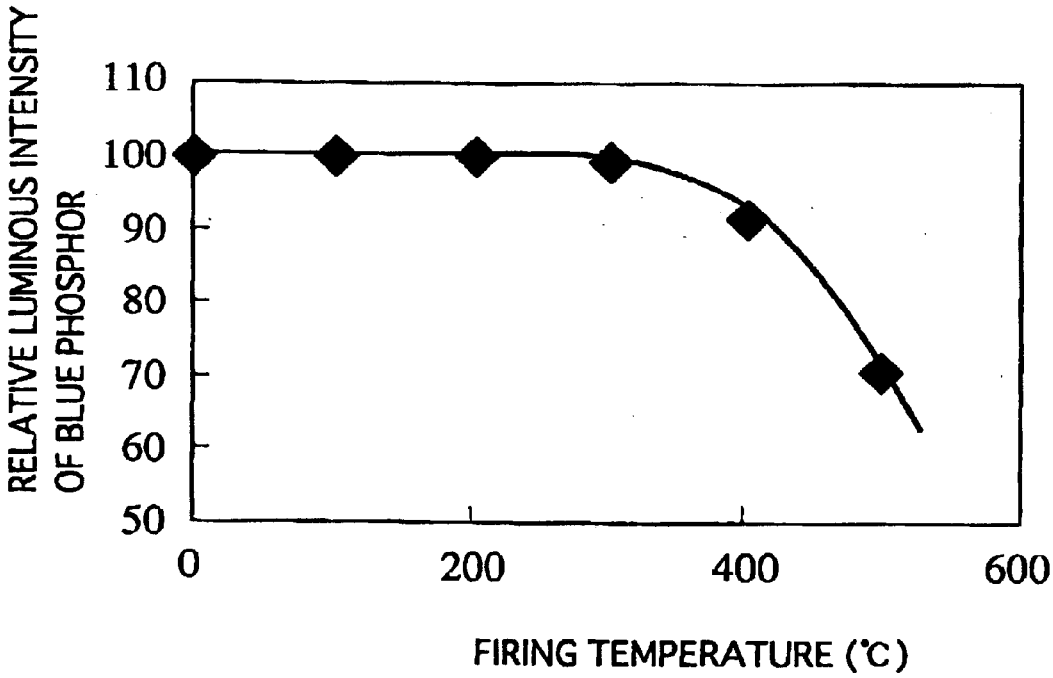
FIG. 7 shows the heating temperature dependence of the luminous intensity, when the blue phosphor is fired in the vapor-containing air through a bubbling device.

Although the discharge voltage dropped to a certain extent just by supplying vapor-containing air without heating the PDP, the discharge voltage dropped more remarkably by heating the PDP at 100° C. or above. The degree of the discharge voltage drop was greater when the heating temperature was higher. This can be attributed to the fact that a greater amount of water vapor remains in the PDP when the PDP is heated at a higher temperature. On the other hand, if the heating temperature is too high, the blue phosphor reacts with the water vapor and as a result the phosphor degrades. FIG. 7 shows the heating temperature dependence of the luminous intensity when firing the blue phosphor in vapor-containing air using the bubbling device. As shown in the drawing, it is preferable to heat the PDP at 350° C. or below, in order to keep the blue phosphor from degrading significantly.

Though the water vapor was automatically introduced into the PDP through the glass tube in the above example, similar effects were obtained by making the ambient atmosphere of the PDP (the atmosphere in the heating furnace) a vapor-containing gas atmosphere. This is probably because the water vapor in the ambient atmosphere naturally substitutes for the gas in the PDP through the glass tube and enters into the PDP. In this case, however, the process needs to be performed for a longer period than the automatic water vapor introduction, to ensure sufficient substitution.

(Third Embodiment)

In the third embodiment, the sealing in the sealing process is performed while supplying dry gas such as air or noble gas whose water vapor partial pressure has been adjusted within 0.13 kPa (1 Torr), as in the above embodiments. In this way, the thermal degradation of the phosphors in the sealing process can be avoided.

Also, instead of introducing water vapor in the discharge gas filling process, the manufacturing operation of this embodiment includes a process of introducing, from halfway through the sealing process, a gas medium such as air or noble gas that contains a predetermined amount of water vapor into the PDP, in order to reduce the discharge voltage.

Figure 8:
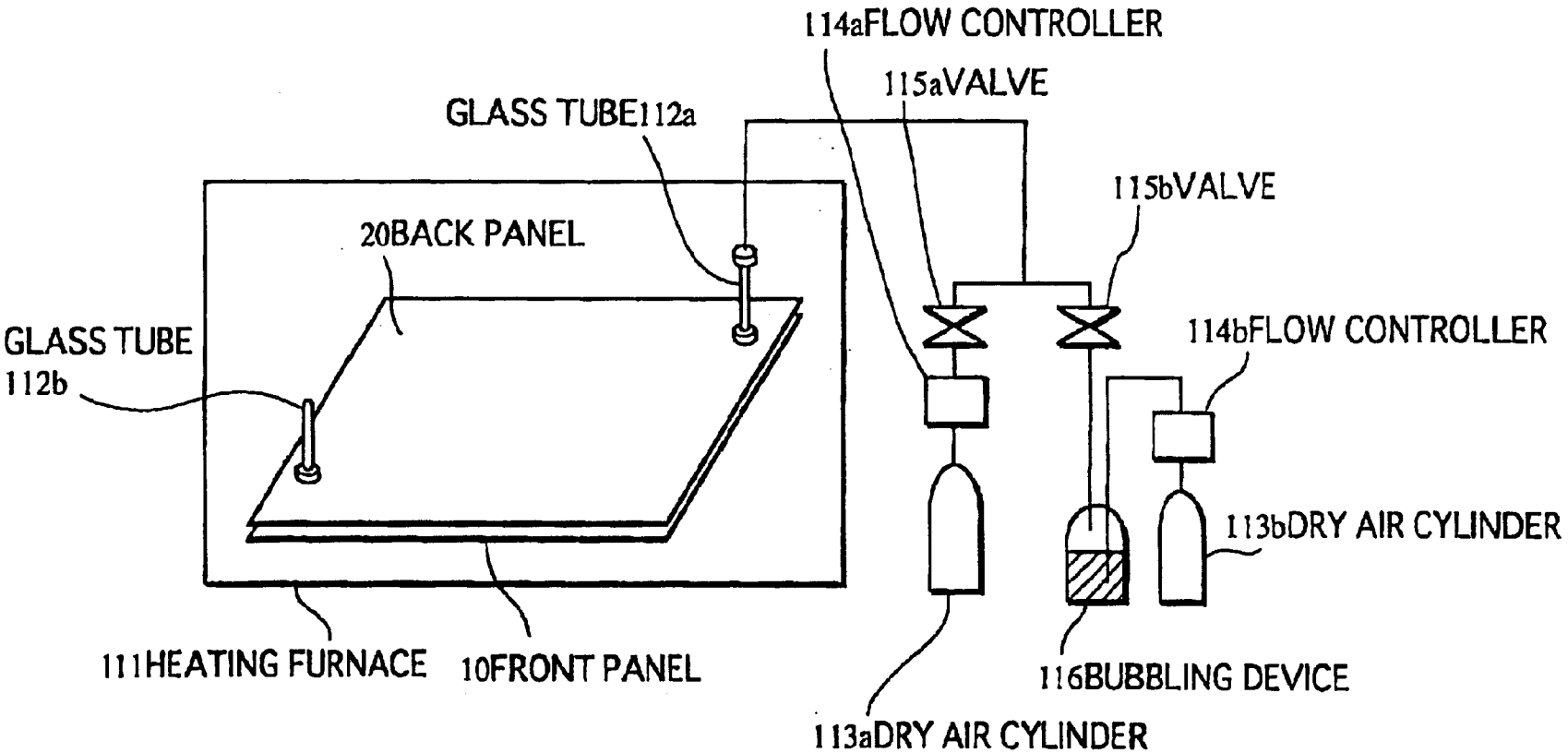
FIG. 8 illustrates a water vapor introduction method in the third embodiment.

This process can be carried out using the following device. FIG. 8 is a plan view of a construction of a manufacturing device used in this process.

First, the front and back panels which have not been sealed yet are sandwiched together and placed in a heating furnace 111. Here, glass tubes 112*a* and 112*b* that also serve as exhaust tubes are provided to the back panel. Dry air cylinders 113*a* and 113*b*, flow controllers 114*a* and 114*b*, valves 115*a* and 115*b*, and a water bubbling device 116 are connected to the glass tube 112*a*. The valves 115*a* and 115*b* are switched to selectively introduce dry air and air that has an adjusted water vapor partial pressure. The introduced air is discharged from the glass tube 112*b*.

With the provision of this device, the introduction of the dry gas and the introduction of the vapor-containing gas are continuously performed by switching the valves without retrieving the PDP from the heating furnace 111. This enables the processes from the sealing to the water vapor introduction to be executed continuously.

Figure 9:
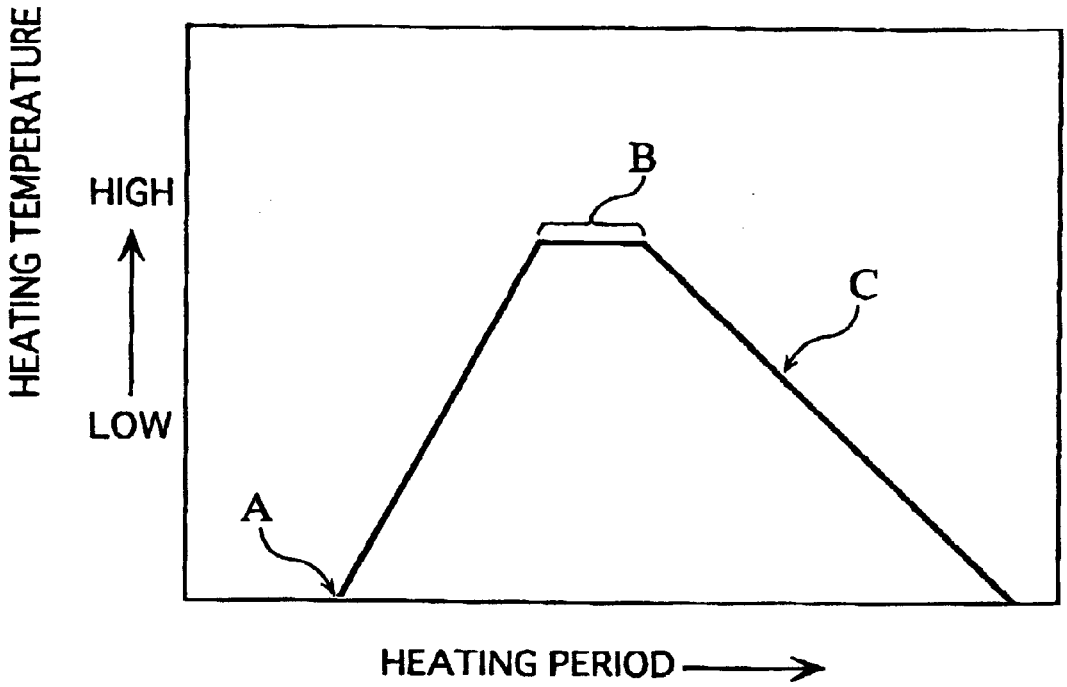
FIG. 9 shows a heating profile of a heating furnace in the third embodiment.
Figure 10:
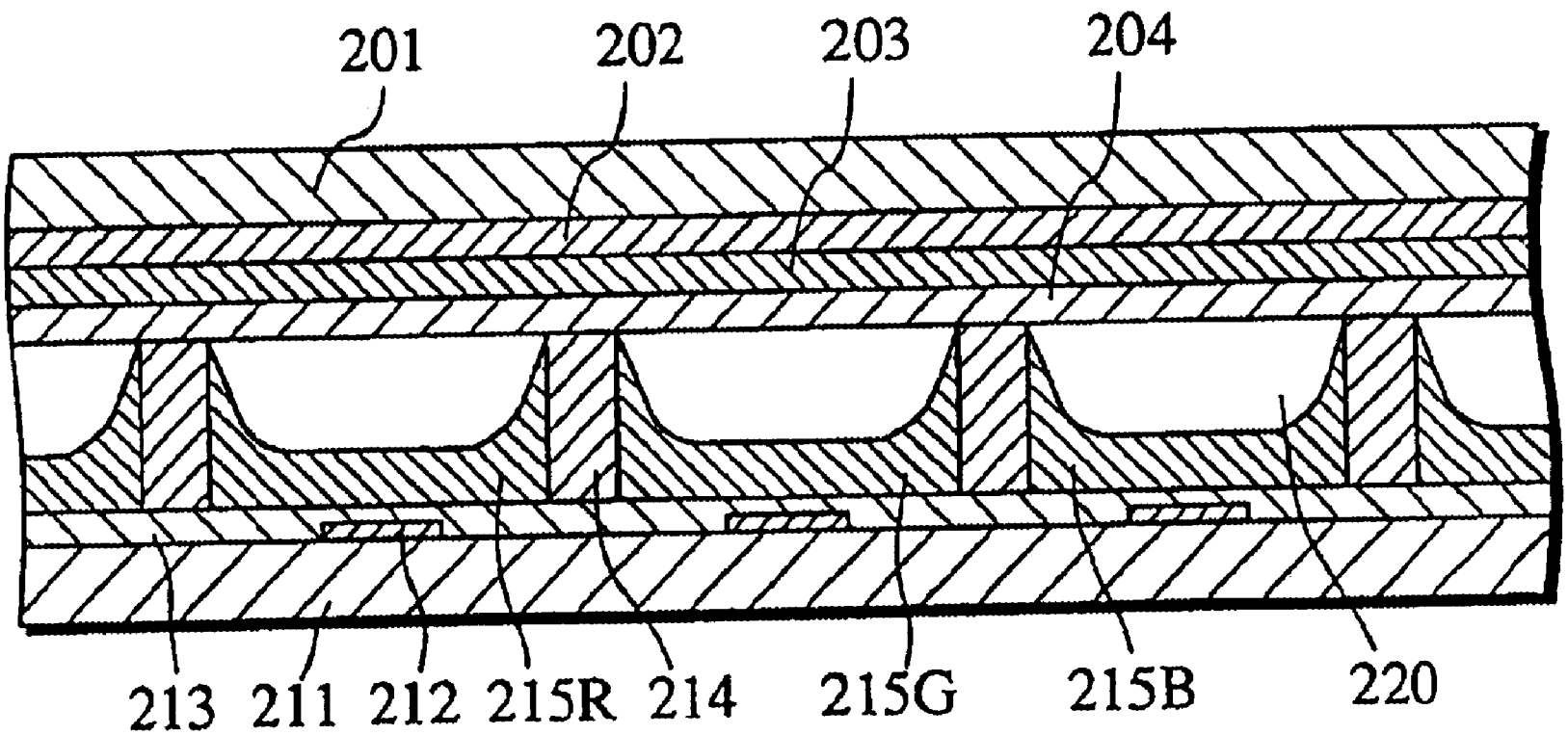
FIG.10 PRIOR ART
FIG. 10 is a sectional view showing a construction of a panel part of a conventional surface discharge AC plasma display device.

FIG. 9 shows a heating profile of the heating furnace in the above manufacturing device. Here, dry air is introduced into the PDP from the beginning of the heating (A in the drawing). The dry air introduction is continued through the peak heating temperature (B) until halfway through the temperature drop (C) In this way, the thermal degradation of the phosphors in the sealing process is prevented. At halfway through the temperature drop (C), the gas flow path is switched by the valves to introduce vapor-containing air via the water bubbling device 116 until the end of the sealing.

The timing (C) with which the introduction of the vapor-containing air starts is preferably when the heating temperature is in a range of 350 to 100° C., as in the above embodiment.

Also, it is desirable to introduce such an amount of water vapor that allows 0.01 to 1% by volume of water vapor to remain in the PDP, as explained in the first embodiment. To do so, the amount of water vapor to be introduced into the PDP need be set such that water vapor in the above defined range remains in the PDP after the evacuation process. It was found that the discharge voltage dropped significantly when the water vapor partial pressure (at ambient temperature) of the introduced air was no less than 1.3 kPa (10 Torr) in the PDP.

While water vapor was automatically introduced into the PDP using the glass tube in the above example, similar effects were obtained by making the PDP ambient atmosphere (the atmosphere in the heating furnace) a vapor-containing gas atmosphere, from halfway through the temperature drop (C). This is probably because the water vapor in the ambient temperature naturally substitutes for the gas in the PDP through the glass tube and enters into the PDP. In such a case, however, it is necessary to perform the process for a longer period than the automatic water vapor introduction, so as to ensure sufficient substitution.

(Actual Example 2)

A plurality of panels were manufactured under different manufacturing conditions based on the second and third embodiments and the like. The characteristics of each panel are shown in TABLE 2.

TABLE 2

MANUFACTURING CONDITION AND LUMINOUS CHARACTERISTIC OF EACH PANEL

| PANEL NO. | HEATING TEMPERATURE IN SECOND EMBODIMENT (° C.) | VAPOR INTRODUCTION TEMPERATURE IN THIRD EMBODIMENT (° C.) | RELATIVE LUMINOUS INTENSITY OF BLUE PHOSPHOR | CHROMATICITY COORDINATE y OF BLUE PHOSPHOR | DISCHARGE VOLTAGE (V) |
|---|---|---|---|---|---|
| 11 | AMBIENT TEMPERATURE | | 100 | 0.090 | 176 |
| 12 | 150 | — | 100 | 0.090 | 168 |
| 13 | 250 | — | 99 | 0.090 | 165 |
| 14 | 350 | — | 97 | 0.092 | 162 |
| 15 | — | 350 | 130 | 0.063 | 175 |
| 16 | — | 250 | 133 | 0.061 | 177 |
| 17 | — | 150 | 135 | 0.060 | 178 |
| 18 | — | — | 135 | 0.060 | 195 |
| 19 | — | — | 100 | 0.090 | 180 |

Panels 11 to 14 correspond to the actual example and were manufactured based on the second embodiment. In each panel, after the sealing process water vapor was introduced into the inner spaces and heating was performed at a different temperature.

Panels 15 to 17 correspond to the actual example and were manufactured based on the third embodiment. In each panel, the introduction of dry gas was switched to the introduction of vapor-containing gas at a different temperature (corresponding to C in FIG. 9).

Panel 18 corresponds to the comparative example. Panel 18 differs with the third embodiment in that dry air was supplied throughout the sealing process without introducing vapor-containing air. Panel 19 corresponds to the comparative example and is the most typical conventional panel which was manufactured without introducing dry air in the sealing process and without introducing water vapor afterward.

The size of each panel was 42 inches. The vapor-containing gas introduced in the panels was air with a water vapor partial pressure of 1.6 kPa (12 Torr) Also, the peak sealing temperature (B in FIG. 9) was 450° C., which was maintained for about 20 minutes.

The construction was the same for each panel, with the thickness of the phosphor layers being 30:m. A gas mixture of Ne (95% by volume) and Xe (5% by volume) was used as discharge gas; which was enclosed at a filling pressure of 66.5 kPa (500 Torr).

In the luminance evaluation test, the luminous intensity (the result of dividing the luminance by the chromaticity coordinate y) and chromaticity coordinate y of the blue phosphor and the discharge voltage (a minimum voltage required to illuminate the entire panel in white color display) were measured. The luminous intensity of the blue phosphor is expressed relative to the luminous intensity of panel 19 which is set at 100.

A comparison of the discharge voltage characteristics indicates that the discharge voltage can be reduced when compared with the conventional panels (panels 18 and 19), by introducing water vapor. The discharge voltage was lower when the temperature at which the water vapor was introduced was higher. However, if the temperature is high enough to exceed the reaction temperature with the phosphor, the water vapor reacts with the phosphor and as a result degrades the luminous characteristics of the phosphor. The water vapor introduction temperature of panels 14 and 15 was barely below this limit. In other words, the temperature at which the vapor-containing gas is introduced is preferably no higher than 350° C., as the phosphor will react with the water vapor when the temperature is over 350° C.

A probable reason why the discharge voltage is lower when the water vapor introduction temperature is higher is given below. As the temperature rises, the water vapor and MgO react with each other, which makes it likely for the water vapor to remain in the panel even after the subsequent evacuation process. The water vapor reacting with MgO remains in the discharge gas as a result of discharge in an aging process (a process for stabilizing discharge characteristics) and the like.

The panels which were sealed under a dry atmosphere (panels 11–18) showed high characteristics in luminous intensity and chromaticity coordinate y, as the thermal degradation of the phosphor was prevented. On the other hand, the panel which was not sealed under a dry atmosphere (panel 19) showed low characteristics in luminous intensity and chromaticity coordinate y, as the thermal degradation of the phosphor was not prevented.

Which is to say, by performing sealing under a dry atmosphere and introducing a predetermined amount of water vapor, both the phosphor characteristics and the discharge voltage can be improved.

The above embodiments describe surface discharge PDPs, but the present invention can also be applied to opposed discharge PDPs.

What is claimed is:

1. A gas discharge light-emitting device in which a discharge space filled with a gas medium is formed and which uses a discharge of the gas medium in the discharge space, characterized in that the gas medium includes 0.01% to 1% by volume of water vapor.

2. The gas discharge light-emitting device of claim 1, wherein the gas medium includes at least one noble gas selected from the group consisting of helium, neon, xenon, and argon.

3. The gas discharge light-emitting device of claim 2, wherein electrodes and phosphors are provided at least in a periphery of the discharge space, and the phosphors (a) are excited by one of ultraviolet light and vacuum ultraviolet light which is generated as a result of the discharge in the discharge space, and (b) emit visible light.

4. The gas discharge light-emitting device of claim 2, wherein phosphors are provided at least in a periphery of the discharge space, one of an electric field and a magnetic field is applied from outside of the discharge space to cause an electrodeless discharge of the gas medium, and the phosphors are excited by one of ultraviolet light and vacuum ultraviolet light which is generated as a result of the electrodeless discharge, and emit visible light.

5. The gas discharge light-emitting device of claim 1, wherein electrodes and phosphors are provided at least in a periphery of the discharge space, and the phosphors (a) are excited by one of ultraviolet light and vacuum ultraviolet light which is generated as a result of the discharge in the discharge space, and (b) emit visible light.

6. The gas discharge light-emitting device of claim 5, wherein surfaces of the electrodes are covered with a dielectric.

7. The gas discharge light-emitting device of claim 6, which is sealed in a state where the phosphors are in contact with a dry gas.

8. The gas discharge light-emitting device of claim 5, which is sealed in a state where the phosphors are in contact with a dry gas.

9. The gas discharge light-emitting device of claim 1, wherein phosphors are provided at least in a periphery of the discharge space, one of an electric field and a magnetic field is applied from outside of the discharge space to cause an electrodeless discharge of the gas medium, and the phosphors are excited by one of ultraviolet light and vacuum ultraviolet light which is generated as a result of the electrodeless discharge, and emit visible light.

10. The gas discharge light-emitting device of claim 9, which is sealed in a state where the phosphors are in contact with a dry gas.

11. A manufacturing method for a gas discharge light-emitting device, comprising:

a sealing step for sealing a first substrate and a second substrate which are placed one on top of the other with an inner space in between so that phosphors provided on the second substrate face the inner space;

an evacuation step for evacuating the inner space to produce a vacuum, after the sealing step; and a discharge gas filling step for introducing a discharge gas that has an adjusted water vapor content, into the inner space after the evacuation step.

12. The manufacturing method of claim 11, wherein the water vapor content of the discharge gas to be introduced into the inner space is adjusted so that the discharge gas having been enclosed in the inner space has a water vapor content in a range of 0.01% to 1% by volume.

13. The manufacturing method of claim 12, wherein the sealing in the sealing step is performed with the phosphors being in contact with a dry gas.

14. A manufacturing method for a gas discharge light-emitting device; comprising:

a sealing step for sealing a first substrate and a second substrate which are placed one on top of the other with an inner space in between so that phosphors provided on the second substrate face the inner space;

a water vapor introducing step for introducing a predetermined amount of water vapor into the inner space, after the sealing step; and an evacuation step for evacuating the inner space to produce a vacuum, after the water vapor introducing step.

15. The manufacturing method of claim 14, wherein the predetermined amount is adjusted so that a water vapor partial pressure in the inner space once the water vapor has been introduced is no lower than 1.3 kPa (10 Torr) at a normal temperature.

16. The manufacturing method of claim 15, wherein a gas medium that includes the water vapor is introduced into the inner space in the water vapor introducing step.

17. The manufacturing method of claim 15, wherein the introduction of the water vapor in the water vapor introducing step is performed while construction elements of the gas discharge light-emitting device are being heated in a range of 100° C. to 350° C.

18. The manufacturing method of claim 15, wherein the sealing in the sealing step is performed with the phosphors being in contact with a dry gas.

19. The manufacturing method of claim 14, wherein a gas medium that includes the water vapor is introduced into the inner space in the water vapor introducing step.

20. The manufacturing method of claim 19, wherein the introduction of the water vapor in the water vapor introducing step is performed while construction elements of the gas discharge light-emitting device are being heated in a range of 100° C. to 350° C.

21. The manufacturing method of claim 20, wherein the sealing in the sealing step is performed with the phosphors being in contact with a dry gas.

22. The manufacturing method of claim 19, wherein the sealing in the sealing step is performed with the phosphors being in contact with a dry gas.

23. The manufacturing method of claim 14, wherein the introduction of the water vapor in the water vapor introducing step is performed while construction elements of the gas discharge light-emitting device are being heated in a range of 100° C. to 350° C.

24. The manufacturing method of claim 23, wherein the sealing in the sealing step is performed with the phosphors being in contact with a dry gas.

25. The manufacturing method of claim 14, wherein the sealing in the sealing step is performed with the phosphors being in contact with a dry gas.

26. A manufacturing method for a gas discharge light-emitting device, comprising:

a sealing step for sealing a first substrate and a second substrate which are placed one on top of the other with an inner space in between so that phosphors provided on the second substrate face the inner space; and an evacuation step for evacuating the inner space to produce a vacuum, after the sealing step, wherein the sealing step includes a water vapor introducing step for introducing a predetermined amount of water vapor into the inner space, when a temperature is dropping after construction elements of the gas discharge light-emitting device have been heated to a peak temperature.

27. The manufacturing method of claim 26, wherein the introduction of the water vapor in the water vapor introducing step is performed when the temperature is in a range of 350° C. to 100° C.

28. The manufacturing method of claim 27, wherein the predetermined amount is adjusted so that a water vapor partial pressure in the inner space once the water vapor has been introduced is no lower than 1.3 kPa (10 Torr) at a normal temperature.

29. The manufacturing method of claim 27, wherein a gas medium that includes the water vapor is introduced into the inner space in the water vapor introducing step.

30. The manufacturing method of claim 27, wherein the sealing in the sealing step is performed with the phosphors being in contact with a dry gas, at least until the construction elements are heated to the peak temperature.

31. The manufacturing method of claim 26, wherein the predetermined amount is adjusted so that a water vapor partial pressure in the inner space once the water vapor has been introduced is no lower than 1.3 kPa (10 Torr) at a normal temperature.

32. The manufacturing method of claim 31, wherein a gas medium that includes the water vapor is introduced into the inner space in the water vapor introducing step.

33. The manufacturing method of claim 32, wherein the sealing in the sealing step is performed with the phosphors being in contact with a dry gas, at least until the construction elements are heated to the peak temperature.

34. The manufacturing method of claim 26, wherein a gas medium that includes the water vapor is introduced into the inner space in the water vapor introducing step.

35. The manufacturing method of claim 34, wherein the sealing in the sealing step is performed with the phosphors being in contact with a dry gas, at least until the construction elements are heated to the peak temperature.

36. The manufacturing method of claim 26, wherein the sealing in the sealing step is performed with the phosphors being in contact with a dry gas, at least until the construction elements are heated to the peak temperature.

37. The manufacturing method of claim 31, wherein the sealing in the sealing step is performed with the phosphors being in contact with a dry gas, at least until the construction elements are heated to the peak temperature.

* * * * *